United States Patent [19]

Pletcher et al.

[11] 4,198,022

[45] Apr. 15, 1980

[54] POWER CABLE GUIDE FOR HIGH-MAST LUMINAIRE RAISING AND LOWERING SYSTEM

[75] Inventors: Jackie E. Pletcher, Zanesville; Brady G. Johnson; Richard G. Armstrong, both of Newark, all of Ohio

[73] Assignee: Johns-Manville Corporation, Denver, Colo.

[21] Appl. No.: 885,405

[22] Filed: Mar. 10, 1978

[51] Int. Cl.[2] ..... B42F 13/00

[52] U.S. Cl. ..... 248/320; 248/123.1; 248/125; 248/327; 362/403; 362/431

[58] Field of Search ..... 362/403, 431; 248/320, 248/123.1, 125, 327

[56] References Cited

U.S. PATENT DOCUMENTS 4,115,845 9/1978 Blahut ..... 362/431

*Primary Examiner*—Stephen J. Lechert, Jr.

*Attorney, Agent, or Firm*—Robert M. Krone; Joseph J. Kelly; Gregory W. O'Connor

[57] ABSTRACT

A method and apparatus for cable support and guidance for use on a high elevation outdoor lighting system in which luminaires, for servicing and inspection, are lowered from an operating position at the top of a pole to a position at the base of the pole. A series of rollers are mounted at the pole top to support and guide the passage of a luminaire, elastomer-jacketed power cable which, during raising and lowering of the luminaires, moves in a path that extends vertically through the interior of the pole, over the roller arrangement and vertically to the luminaires on the exterior of the pole.

6 Claims, 4 Drawing Figures

POWER CABLE GUIDE FOR HIGH-MAST LUMINAIRE RAISING AND LOWERING SYSTEM

BACKGROUND OF THE INVENTION

This invention relates generally to a method and apparatus for guiding the passage of a moving elastomer-jacketed cable from one vertical path, through 180°, to another vertical path. More particularly, the invention relates to a method and apparatus for use at the top of a high elevation lighting pole for guiding a moving power cable through 180° from its path within the interior of the pole to the exterior of the pole where the cable connects with a cluster of luminaires which are lowered from the pole top to the base of the pole for servicing.

It is a practice in the high-mount lighting industry to employ self-contained raise/lower devices to bring luminaires down to the ground for maintenance instead of using bucket trucks, special rigs and similar devices for raising maintenance personnel to the luminaires. One known luminaire lowering system includes a luminaire ring assembly on which the luminaires are mounted and which ring assembly is mounted around a pole for movement along the vertical extent of the pole when the ring assembly is hoisted and lowered by hoisting cables attached to the assembly. The hoisting cables, typically three in number, extend from the ring assembly through a pulley system that is attached to the top of the pole and down through the interior of the pole to the base of the pole where they connect to a power winch. Electrical power is supplied to the luminaires by means of a power cable which runs from the luminaire assembly over a single pulley, down through the interior of the pole to the pole base, where it connects to the power source by way of a twistlock disconnect and circuit breaker. In the region of the disconnect, the power cable is attached to the hoisting cables such that when the luminaires are to be lowered, the power cable is disconnected from the power source so that the bulk of the power cable moves outwardly through the pole, around the power cable pulley at the top of the pole and downwardly on the outside of the pole with the lowering luminaire assembly. Problems arise during the raising and lowering operation because the elastomer-jacketed power cable tends to "walk" up over the rim of the pulley, especially when some twist exists in the cable. This occurs because the elastomer cable jacket, moving at the same tangential speed as the pulley, tends to frictionally grasp a side of the pulley groove and be carried away from the base of the pulley groove. This leads to jams in the pole top apparatus which in turn necessitates the expense of servicing and repair.

It is recognized, for proper guidance of a cable of given size through a 180° turn, that the turning radius of the pulley, or other guiding means should be at least large enough to prevent internal chafing and twisting of conductors of that cable. For guidance of a power cable of the size and type typically employed with high-mount luminaires a pulley of appreciable size has been necessary. The circular profile displayed by such a pulley in a vertically extending plane at a pole top (and this includes the lower 180° segment of the pulley which at any instant is not actively guiding the cable) tends to increase wind resistance and therefore adversely affect the wind performance rating of the pole.

It is an object of the invention to provide for the turning of an elastomer-jacketed power cable from one vertical path to another parallel path without the risk of jamming of the cable.

It is also an object of the invention to provide, at a high elevation pole top, for the guidance of a moving elastomer-jacketed power cable through a turn from one path to another parallel path, through a reasonable bending radius, i.e., a large enough radius to prevent internal chafing and twisting of conductors, while maintaining a minimal projected area in a vertical plane so as to reduce wind produced stress on the mounting pole.

SUMMARY OF THE INVENTION

Accordingly, the present invention relates to method and apparatus for turning a moving elastomer-jacketed cable from one direction through a 180° turn to the opposite direction and includes a series of spaced individual rotatable means which in the preferred embodiment comprises free-wheeling rollers mounted in parallel axial relationship along a generally arcuate line, the rollers being mounted between two spaced-apart support plates, portions of which serve to limit lateral movement of the cable. The invention also encompasses the utilization of such method and apparatus with a system for raising and lowering electrically energizable assemblies along a vertically extending pole that includes an elastomer-jacketed power cable extending from the electrical assembly through a cable guide means at the pole top and on to the pole base.

In a preferred embodiment of the invention there is movement of the power cable over rollers in a first arcuate path and then over rollers in a second arcuate path, the radii of curvature of the arcuate paths being equal and the centers of curvature being in the same horizontal line and spaced a distance from each other.

DETAILED DESCRIPTION OF THE DRAWINGS

Figure 1:
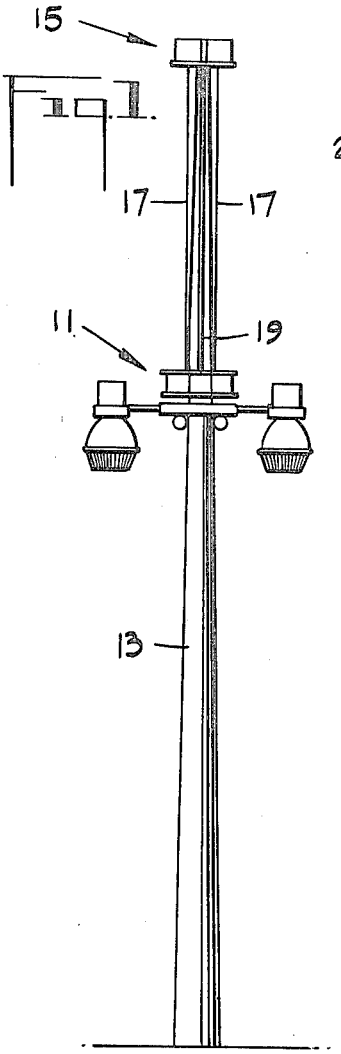
FIG. 1 is a schematic illustrating a system for raising and lowering luminaires on a high elevation pole, utilizing the cable guide mechanism of the invention.

Referring to the drawings, FIG. 1 shows a luminaire ring assembly 11 which is mounted around a high rise steel pole 13 for movement up and down the exterior of the pole 13 and supported during raising and lowering by steel cables 17 which attach to the ring assembly 11, extend upwardly to a pole-top assembly 15 then downwardly through the interior of the pole to a cable winch assembly (not shown) located at the base of the pole 13. As partially shown in FIG. 2, cables 17 emerge through a hole at the center of support plate 21, each cable passing around one of three pulley assemblies 23 which assemblies are secured to the support plate 21 and are equally spaced about the center of support plate 21. The electric power cable 19 also passes through the hole in the center of support plate 21 and then through a guide assembly 25 which is secured to the support plate 21, and downwardly through a hole at 28 in the plate 21 to terminate at a junction box 29 carried on the luminaire support rings 26. Individual luminaire electrical cables (not shown) lead from the junction box 29 to the individual luminaires (not shown). The main power cable 19 typically comprises a multi-conductor core encased in an electrically insulating elastomer such as a rubber neoprene sheath. At the interior of the pole base, when luminaires are in raised position, a lower terminus of power cable 19 connects with a power source by way of a twist lock disconnect and circuit breaker (not shown). In the region of the disconnect power cable 19 is attached to cables 17 such that once power cable 19 is disconnected from the power source it may move upwardly and downwardly with cables 17 during raising and lowering of luminaires.

Figure 2:
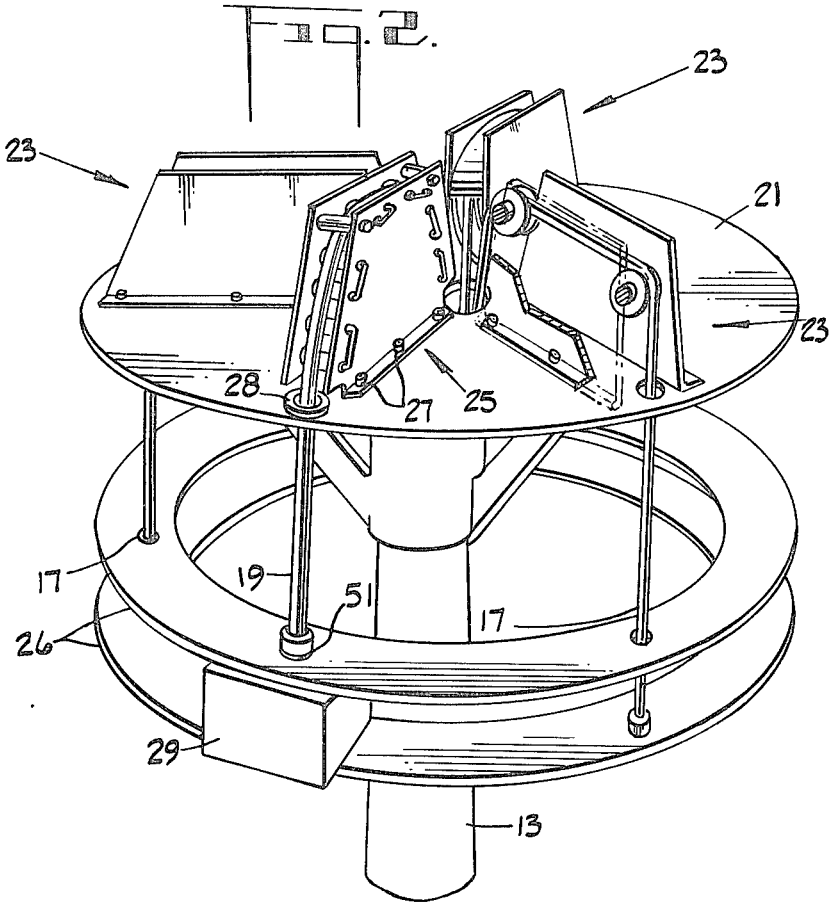
FIG. 2 is a perspective view of a pole-top power cable guide means of the invention.
Figure 3:
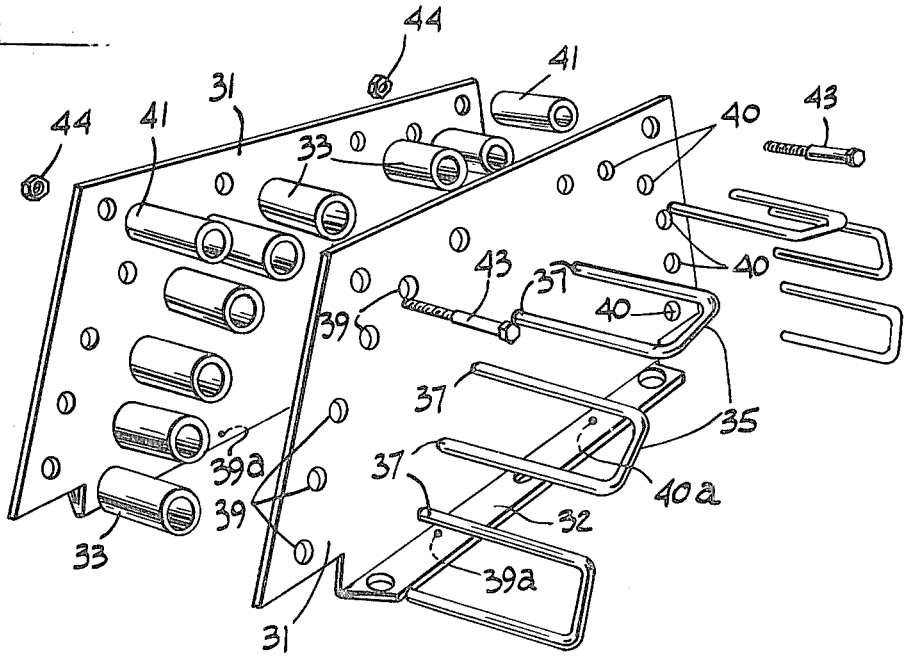
FIG. 3 is an exploded view in perspective of a power cable guide assembly of the invention.
Figure 4:
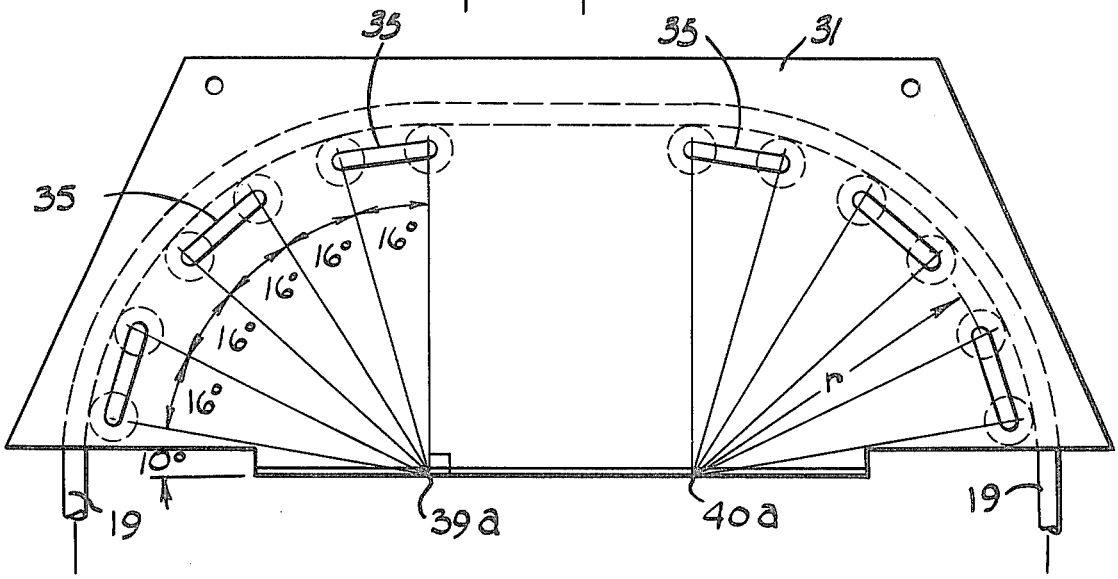
FIG. 4 is a side elevation view of the power cable guide assembly.

As best shown in FIG. 3, the preferred embodiment of the power cable guide assembly includes two spaced-apart support plates 31 preferably constructed of plated steel. At the lower end of each plate 31 is flange 32 which is drilled for receiving bolts 27 by which each plate 31 is secured to the support plate 21, as shown in FIG. 2. Plates 31 are secured in the desired spaced-apart, parallel relationship at their top portions by use of two tubular aluminum spacers 41 which are rigidly secured in place by bolts 43 and nuts 44. As illustrated in FIG. 4, in each plate 31 there is drilled a first series of holes 39 the centers of which lie on an arc of a circle the center 39*a* of which is located on the base of flange 32. A second series of holes 40 are drilled in each plate 31 with the centers of holes 40 lying on an arc of a circle having a center 40*a* on the base of flange 32. Thus, the centers 39*a* and 40*a* lie in a common plane. Stainless steel, U-shaped axles 35 pass through holes 39 and 40 of one bracket 31, through the bores of rollers 33 and through corresponding holes in the other bracket 31 and are retained in place by the swagging of axle ends 37. Thus rollers, preferably six in number, are mounted along each of the respective arcs about centers 39*a* and 40*a*. Rollers within each set are spaced apart so that their axes of rotation lie on radial lines about centers 39*a* and 40*a* respectively that are about 16° apart, with one roller lying directly vertically above the centers 39*a* and 40*a* respectively. The rollers 33 are preferably constructed of a durable synthetic material such as that manufactured and sold by DuPont under the trademark DELRIN. Rollers of this self-lubricating material, combined with stainless steel axles 35, form a maintenance free roller assembly. In the preferred embodiment rollers 1.38" in width, 0.87" in outside diameter and having a bore of 0.26" are mounted on ¼' diameter axles. The spacers 41 which are slightly wider than rollers 33, hold the brackets 31 spaced apart for 1.48".

In FIG. 4 r represents at least the minimum bending radius for a given power cable as recommended by the cable manufacturer. Thus the centers of axle holes 39 and 40 lie on arcs having radii equal to a distance r less the sum of the thickness of rollers 33, the radius of axles 35, and the radius of cable 19. A variety of power cables of differing sizes and styles may be used with the invention. The mounting of the rollers is such that the cable employed will be guided through a reasonable bending radius, i.e., a radius large enough to prevent internal chafing and twisting of conductors and small enough to minimize the projected surface area of the assembly 25 in a vertical plane. For example, in the preferred embodiment the rollers are mounted so as to turn a typical luminaire power cable such as a 8–2 gauge, 65 amp. conductor, 2 conductor cable of 0.81" diameter through an r of 6.47"; which r value is large enough to properly accommodate such a cable, which has a minimum recommended bending radius of 4.86", yet is small enough not to present the pole-top assembly with too large of a wind catching profile. The centers 39*a* and 40*a* are spaced apart for a horizontal distance which is determined by the horizontal spacing between the vertically hanging portion of cable 19 lying within the pole core and the vertically hanging external run of cable 19. This distance generally varies with the diameter of the luminaire support ring 26. For example, in the preferred embodiment shown in FIG. 2 the horizontal distance between the center of pole 13 and the center of attachment point 51 on the support rims 26 is approximately 17". This requires the distance between centers 39*a* and 40*a* shown in FIG. 4 to be approximately 4.1". The invention can be modified to accommodate smaller support rings by accordingly decreasing the distance between centers 39*a* and 40*a* up to the point where these centers coincide.

In the operation of the apparatus according to the invention, during the raising or lowering of the luminaire assembly 11 as in FIG. 1, which shows luminaire assembly 11 in an intermediate position along pole 13, power cable 19 moves over the twelve rollers 33 the frictional force between cable jacket and the roller outer surfaces causing the rotation of the rollers on their axles. Portions of the brackets 31 adjacent the rollers 33 serve to limit lateral movement of power cable 19. Since these wall portions do not move with the cable 19 as it is carried through its path over the rollers 33, there exists no tendency for the elastomer cable jacket to frictionally grasp these wall portions in a manner which carries the cable 19 away from the surfaces of rollers 33. The two spacers 41 serve additionally as a keeper for the moving power cable 19.

Various modifications of the above-described embodiment of the invention will be apparent to those skilled in the art, and it is to be understood that such modifications can be made without departing from the scope of the invention if they are within the spirit and the tenor of the accompanying claims.

What is claimed is:

1. In a system for raising and lowering an electrical assembly along the exterior of a vertically extending highelevation pole including an elastomer-jacketed power cable extending in a first vertical path upwardly from said electrical assembly, through power cable guide means located at the top of said pole and to a second vertical path downwardly toward the base of said pole, the improvement in said power cable guide means comprising:

a series of individual rotable means mounted on horizontal axes along a generally arcuate path, for guiding the movement of said power cable from said first vertical path to said second vertical path; and means adjacent the ends of said individual rotatable means for limiting lateral movement of said cable.

2. A system as defined in claim 1 wherein said said individual rotatable means comprises rollers mounted between two spaced-apart support plates and wherein said means for limiting lateral movement of said cable comprises portions of said plates.

3. A system as defined in claim 2 wherein one half of said rollers are mounted on a first arcuate path and another half of said rollers are mounted along a second arcuate path, said paths having equal radii of curvature, the center of curvature of each arc lying on the same horizontal line with said centers being spaced a distance apart, said arcs extending for 90° above said horizontal line.

4. A system as defined in claim 3 wherein there are at least six rollers in each arcuate path, the rollers in each of said paths having rotational axes lying on radial lines emanating respectively from each of said centers of curvature, said lines being about 16° apart, and there being a roller located vertically above each center of curvature.

5. A system as defined in claim 4 wherein the radii of curvature of said arcuate paths are such that said cable is guided on said rollers through at least its minimum bending radius.

6. A method for guiding an elastomer-jacketed power cable in its movement from a first, vertically upward path into a second, vertically downward path, comprising:

moving said cable in a generally arcuate path over two series of rollers, the rollers in each series lying in an arc the radius of curvature of which is at least large enough such that said cable is not turned through a curve having a radius less than the bending radius of said cable, and confining the lateral movement of said cable by means of sationary surfaces during the movement of said cable in its arcuate path.

* * * * *

UNITED STATES PATENT AND TRADEMARK OFFICE

CERTIFICATE OF CORRECTION

PATENT NO. : 4,198,022

DATED : April 15, 1980

INVENTOR(S) : Jackie E. Pletcher et al

It is certified that error appears in the above-identified patent and that said Letters Patent are hereby corrected as shown below:

Column 3, line 48, "'" should be --"--.

Column 4, line 44, "highelevation" should be --high-elevation--.

Column 4, line 58, second occurrence,"said" should be deleted.

Column 6, line 11, "sationary" should be --stationary--.

Signed and Sealed this

*Second* Day of *September 1980*

[SEAL]

*Attest:*

SIDNEY A. DIAMOND

*Attesting Officer*

*Commissioner of Patents and Trademarks*